United States Patent [19]

Schroeder et al.

[11] 4,441,709

[45] Apr. 10, 1984

[54] MOVABLE BASKETBALL HOOP STRUCTURE

[75] Inventors: Edward A. Schroeder, Algounquin; William F. Donat, Franklin Park, both of Ill.

[73] Assignee: Porter Equipment Co., Schiller Park, Ill.

[21] Appl. No.: 312,990

[22] Filed: Oct. 19, 1981

[51] Int. Cl.[3] ..... A63B 63/08

[52] U.S. Cl. ..... 273/1.5 R

[58] Field of Search ..... 273/1.5 R, 1.5 A; 172/261-269

[56] References Cited

U.S. PATENT DOCUMENTS

| | | | |
|---|---|---|---|
| Re. 20,898 | 10/1938 | Schabinger . | |
| 323,004 | 7/1885 | Wheeler | 172/269 X |
| 397,962 | 2/1889 | Bird | 172/269 X |
| 444,986 | 1/1891 | Bloominger | 172/269 X |
| 468,764 | 2/1892 | Flatau | 172/269 X |
| 790,410 | 5/1905 | Warne | 172/269 X |
| 4,111,420 | 9/1978 | Tyner . | |
| 4,151,989 | 5/1979 | Dittrich . | |
| 4,194,734 | 3/1980 | Tyner . | |
| 4,285,518 | 8/1981 | Pearo . | |
| 4,348,022 | 9/1982 | O'Donnell | 273/1.5 R |
| 4,365,802 | 12/1982 | Ehrat | 273/1.5 R |

FOREIGN PATENT DOCUMENTS

| | | | |
|---|---|---|---|
| 36158 | 4/1967 | Finland | 172/269 |

OTHER PUBLICATIONS

Slam Dunk Rim, Inc. Advertising Circular, 4-1978, Type 1, "Slam Dunk".

*Primary Examiner*—Paul E. Shapiro

*Attorney, Agent, or Firm*—Leitner, Palan, Martin & Bernstein

[57] ABSTRACT

In a movable basketball hoop structure, a detent of the lock mechanism rides along a rail in the unlocked position to retard the pivotal motion of the hoop. The rail also forms part of the return assembly and the compression elements of the return mechanism is interconnected to the detent to bias the detent against the rail in the locked and unlocked positions.

15 Claims, 5 Drawing Figures

MOVABLE BASKETBALL HOOP STRUCTURE

BACKGROUND OF THE INVENTION

The present invention relates generally to basketball goal hoop and mounting structure and, more specifically, to a movable basketball goal hoop mounting structures.

The slam dunk has created much concern in the basketball game since it results too frequently in the shattering of glass backboards. This is not only dangerous but interrupts the game and requires time to replace the glass backboard and mount thereon the rim. One solution of the problem is to not mount the hoop structure directly to the backboard and, thus, relieves the problems at the interface. A typical example is U.S. Pat. No. 4,285,518 to Pearo wherein the basketball goal is mounted to the steel mounting bracket of the glass board through an opening in the glass backboard.

Another solution to the problem is to provide a mounting assembly for the goal structure which is pivotally connected to the backboard such that it will deflect upon receiving load of the slam dunk. A typical example of such a pivotal connection is illustrated in U.S. Pat. Nos. 4,111,420 and 4,194,734 to Tyner. Similarly, a basketball practicing device without a backboard which is to be used in the practice of dunk shots is illustrated in U.S. Pat. No. 4,151,989 to Dittrich. These types of systems are known as "movable basket rings" and are being considered by the National Collegiate Athletic Association (NCAA). The following specification has been approved for the NCAA for movable basket rims:

1. Have pressure release mechanism with positive lock characteristics which shall assure stability and adherence of the basket ring to the backboard.

2. The pressure release mechanism must not disengage until a static load of 230 pounds has been applied to the top of the ring at the most distant point from the backboard. The pressure release mechanism must be preset and sealed by the manufacturer at the required static load setting.

3. The moveble ring shall have identical re-bound characteristics as a non-movable ring.

4. When released, the ring shall not rotate in excess of 30° below the original horizontal position.

5. After being released and the load is no longer applied, the ring shall automatically and instantaneously return to the original locked position.

The Tyner devices will not meet the specification in that they do not have a positive lock that will not disengage until a static load of 230 pounds is applied.

A movable basketball ring being sold by Slam-Dunk Incorporated is a modification of the Tyner system with a positive lock at the upper edge. The lock includes a pair of opposed spring loaded detents resting in the indenture of a post extending from the backboard. The detents are adjacent the juncture of the L-shaped hoop structure which pivots from the bottom as in Tyner. The problem with this board as well as with Tyner is that upon the force produced by the return spring must be sufficiently strong to overcome the biasing of the detent springs. This force causes the vertical part of the L-shaped member to slam hard against the backboard which is undesirable since it may cause fatique in the glass backboard. Similarly, the pivotable motion of the hoop is limited by the return spring bottoming out. This stopping by bottoming out instead of by deceleration causes the momentum produced to bend the rim and create stress at the point that the rod, upon which the spring travels, is connected to the backboard or mounting structure.

Another movable basket ring is sold by Toss Back Incorporated. This system includes a hoop structure pivotally mounted at a point displaced from the backboard and includes a vertical member extending down and received between a pair of jaws as a locking means and a second vertical member about which the return spring is wrapped. Although removing the problem of stopping the return of the hoop to the horizontal position at a point other than the backboard, it still does not provide a deceleration of the motion of the hoop downward and uses a bottoming out of the return spring to limit the vertical motion as in the Slam Dunk device, the Toss Back device requires that the return spring produce sufficient velocity that the first vertical member is driven into the lock position and overcoming the spring tension of the lock.

SUMMARY OF THE INVENTION

An object of the present invention is to provide a movable basket ring which meets the NCAA proposed standards.

Another object of the present invention is to provide a movable basketball hoop which retards the pivotal movement of the hoop from the horizontal position and attempts to decelerate the pivotal motion before it comes to rest at its limited pivotal position.

Still another object of the present invention is to minimize the number of parts used in providing a movable basketball hoop assembly.

Still an even further object of the present invention is to eliminate the requirement of the return spring to overcome the locking force of the locking device for a movable basketball hoop assembly.

These and other objects of the invention are attained by constructing the lock mechanism, which maintains the hoop in a horizontal position until a predetermined force is applied, with an extended rail having an indenture to receive a detent in the lock position and causing the detent to travel along the length of the rail during the pivotal motion in the unlock position so as to retard the pivotal motion of the hoop structure. The rail also forms part of the return device which includes a first seat mounted to the rail and a second seat movably mounted thereon with a compression means between the two seats. An interconnect is provided between the detents and the compression means such that the compression means forms the bias for the detent which biasing increases with increased travel of the hoop from the horizontal and the motion of the detent moving from the lock to the unlock position immediately increases with the compression means. The compression means includes a spring and a solid mass whereby the solid mass absorbs the energy in the final portion of the pivotal motion of the hoop structure after the spring has bottomed out to prevent an abrupt stoppage of the pivotal motion of the hoop structure. The hoop structure is mounted to pivotally rotate at a point on a support structure displaced from the backboard to prevent undue stress on the backboard when the structure returns to the locked position.

Other objects, advantages and novel features of the present invention will become apparent from the following detailed description of the invention when considered in conjunction with the accompanying drawings.

DESCRIPTION OF THE PREFERRED EMBODIMENTS

Figure 1:
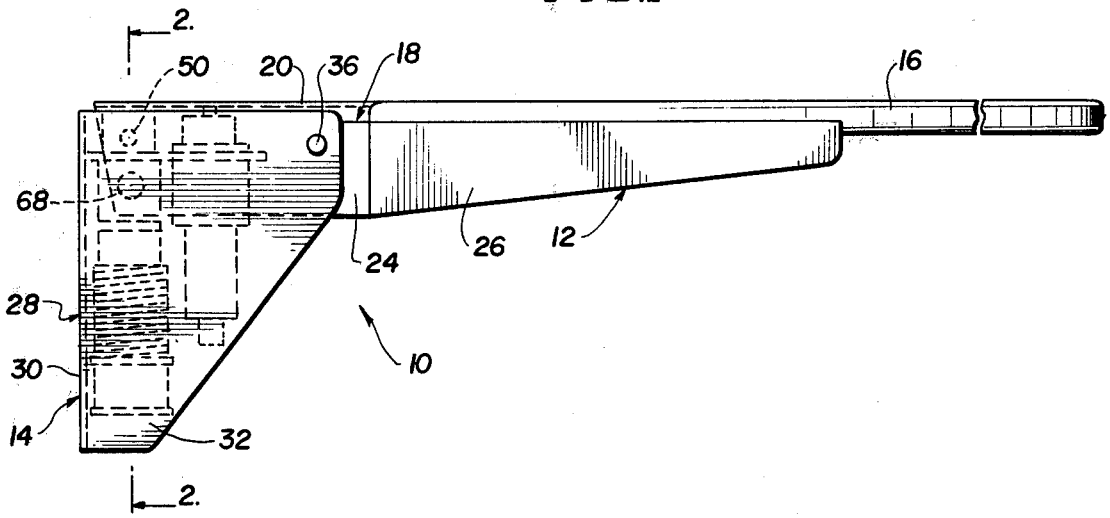
FIG. 1 is a side view of a basketball hoop mounting assembly in the locked or playing position.
Figure 2:
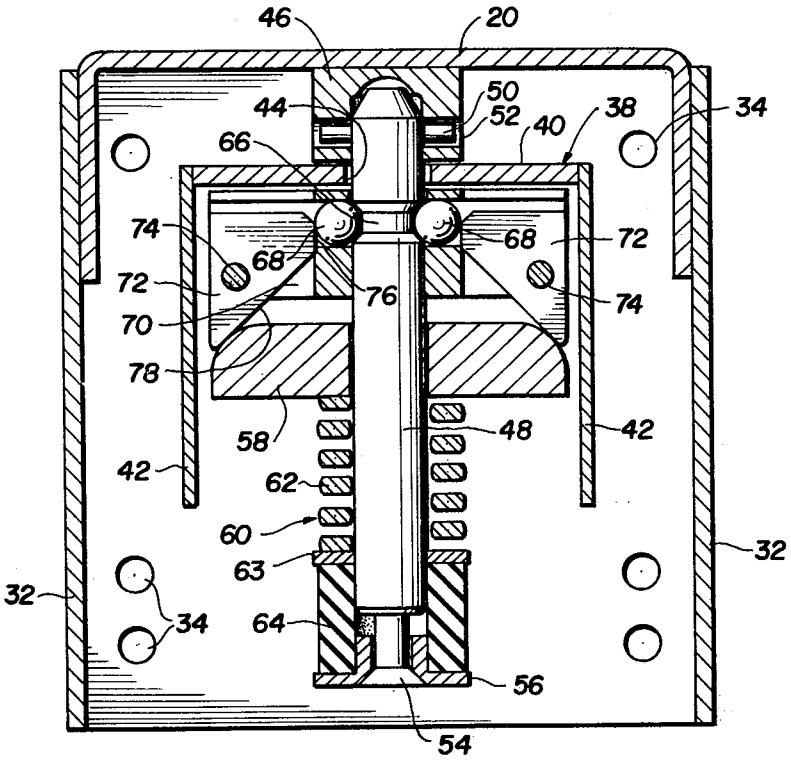
FIG. 2 is a cross-sectional view taken along the lines 2—2 of FIG. 1.

As illustrated in FIG. 1, the basketball goal 10 includes a hoop structure 12 and a support structure 14. The hoop structure 12 includes a hoop 16 secured to a U-shaped element 18 having a base portion 20 and a pair of legs 24. An apron 26 extends from the front edge of legs 24 and adds additional support for the hoop 16. The support structure 14 includes a U-shaped element 28 having a base 30 and a pair of extending legs 32. Openings 34, as shown in FIG. 2, in the base 30 are provided to receive fasteners to mount the support structure to the backboard or backboard support structure. The hoop structure 12 is pivotally mounted by pins 36 extending through the legs 24 of the hoop structure and legs 32 of the support structure. The pins 36 and thus the axis of rotation of the hoop structure is displaced from the base element 30 of the support structure which, when mounted will lie directly on the face of the backboard. This displacement, as will be explained more fully below, allows the stopping of the movable hoop structure from its deflected back to its locked position to be absorbed by the support structure and not by the face of the backboard.

Mounted interior the U-shaped support structure 28 and directly to the base element 30 is a third U-shaped structure 38 having a base portion 40 and a pair of legs 42. An opening 44 is provided in the base portion 38.

Figure 3:
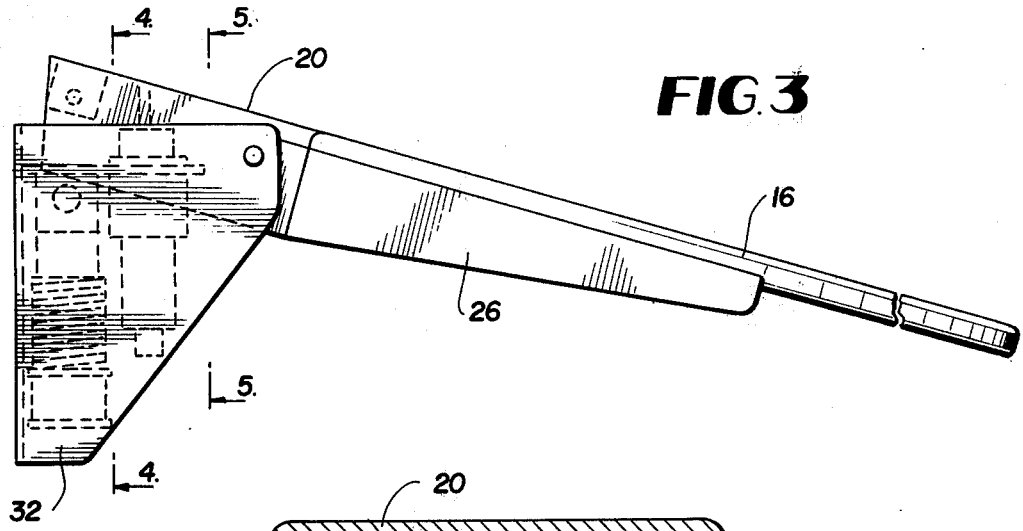
FIG. 3 is a side view of a basketball hoop mounting assembly in its lower limit of pivotal deflection.

Although not shown in the drawings, the opening 44 is elongated out of the plane of FIG. 2 and along the horizontal face in FIGS. 1 and 3 to allow for the horizontal component motion of rail 48 to be described hereafter. Mounted to the lower face of base 20 of the hoop structure 12 is a U-shaped bracket 46. A rail 48 is received in the interior of the U-shaped bracket 46 and held therein by a pin 50 traversing opening 52 in the side walls of the bracket 46 and an aperture (not shown) in the top of the rail 48. Mounted to the other end of the rail 48 by a fastener 54 is a first seat element 56. A second seat element 58 is slidably mounted about the rail 48. A compression system 60 including springs 62 and a compressible mass 64 rests between the seats 56 and 58. Fasteners 54 allows for adjustment of the position of the seat 56 and, consequently, the initial forces on the compression system 60. As will be described later, the compression system not only provides a return mechanism to bring the deflected hoop structure 12 back to its locked position, but also acts to absorb the momentum in the downward motion to prevent abrupt stopping of the hoop structure 12 at its lower limit of travel.

Figure 4:
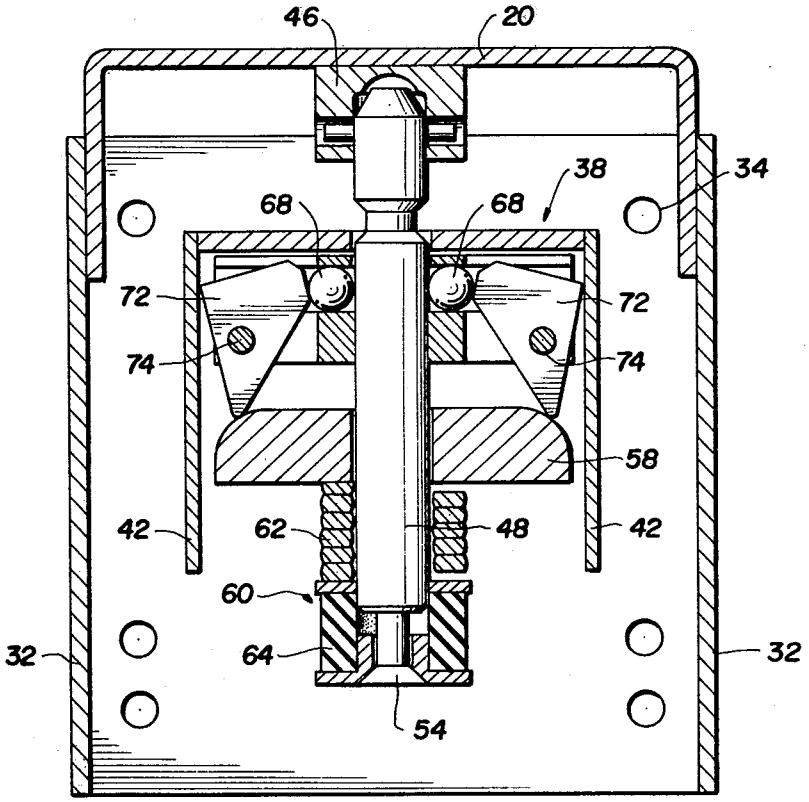
FIG. 4 is a cross-sectional view taken along the lines 4—4 of FIG. 3.

The lock for the movable hoop structure of the present invention includes an annulus indenture 66 in the rail 48. A pair of detents 68 which are illustrated as balls are positioned in the indenture 66 in the lock position as illustrated in FIG. 2 and will ride along the exterior or lateral force of the rail 48 as it moves from the lock position to the unlocked position as illustrated in FIG. 4. The detents 68 ride in housing 70. A pair of cams or interconnect devices 72 are pivotally mounted to the interior of the lock housing 70 by pins 74. Surface 76 of the interconnects 74 rests the detents 68 and the surface 78 of the interconnects 74 rest along the upper surface of the second seat 58. The detents 68 and the rail 48 are made of case hardened steel to extend the life of the system.

In the locked or play position, the hoop 16 is in the position illustrated in FIG. 1 and 2 with the hoop horizontal. The rail 48 is locked in place by detents 68 resting in indenture 66. The compression system 60 is extended and biases the detents 68 via the second seat 58 and the interconnect elements 72. It should be noted that the second seat 58 and the lock housing 70 are slidably received on the rail 48 and are held from upward motion in FIG. 2 by the base plate 40. The compression system 60 is sufficient to maintain the detents 68 in the indenture 66 until at least 230 pounds are applied to the hoop 16. At this point, the force applied to the hoop is sufficient to overcome the biasing of the detents 66 and the rail 48 begins to move up in FIG. 2.

The detents 68 are being forced from their lock position to their unlocked position by the upward movement of the rail 48. This motion of the detents 68 from the lock to the unlock position is transmitted to the compression system 60 via the interconnect 72 and the second seat 58. This immediately moves the second seat 58 down relative to the stationary support structure to immediately increase the compression on spring 62. This increased compression is applied back through the interconnects 72 to the detents 66 which ride along the exterior lateral face of the rail 48. The frictional engagement of the detents 68 with the rail 48 attempts to retard the movement of the rail 48 which is being driven by the force on the hoop 16. With increase travel of the hoop 16 and the rail 48, the spring 62 becomes further compressed which increases the force applied to the detents 68 and, consequently, to the rail 48. Thus, the retarding effect is increased with increased rotational travel of the hoop 16 from the locked horizontal position to the deflected position.

As the rail 48 continues to rise, the springs 62 of the compression system bottoms out and the resilient mass 64 begins to compress. The resilient mass may be, for example, polymer such as S.A.E. designation J200 or other type of resilient mass which will not deform until it receives an excessive load. The resilient mass 64 acts as a shock absorber after the spring 63 has bottomed out to quickly decelerate the hoop 16 without a sudden stop. This prevents the continuation momentum which could cause bending of the hoop 16. This will also relieve the stress on the hoop support structure which is produced by the spring 62 bottoming out by itself. As illustrated in FIGS. 3 and 4, the hoop has come to a rest and its deflected position with the maximum movement of 30°. This is within the specification described above for the NCAA.

By providing the detents to ride along the surface of rail 48, the compression system 60 did not have to overcome the biasing of the detents 68 in its returned motion to reset or lock the hoop structure 12 in its horizontal or playing position as required by prior art lock devices. By using a single rail 48 for the lock mechanism as well as the return mechanism fewer parts are required and the device is very compact. The interconnecting structure 72 allows the compression device 62 to be used in the return mechanism as well as biasing for the lock mechanism. Similarly, these combinations allow the detents 68, to be part of the lock system and a retard system to help retard the pivotal motion of the hoop after becoming unlocked and to help decelerate movement of the hoop. Although the locked and retard mechanisms use the rail and compression means of the return mechanism and this is preferred, they may have a separate and distinct rail and biasing. This would produce the same results in that the detents of the lock mechanism could be used as the retarding force and the rail will keep the detents spread so that the return mechanism would not have to overcome the detent biasing forces to reset the lock mechanism.

Although the compression system 60 is illustrated as having a spring 62 and a resilient mass 64, it may be built only with a spring 62 if desired although it is not preferred since the resilient mass 64 helps absorb the final motion of the hoop structure after the spring 62 bottoms out. Although the system has been described and illustrated such that the rail 48 is mounted to the hoop structure to move therewith and the detent or lock system and the second seat 58 are shown to be mounted substantially to the support structure and to be stationary during the movement of the loop structure, these functions may be reversed. The important relationship is that they move relative to each other and that they reflect the motion of the hoop relative to the support structure.

To meet NCAA requirements, a face plate may be provided, though not shown, between the legs 32 so as to seal off the adjustment 54 of the compression mechanism 60. Similarly, this plate is a safety feature to prevent athletes from getting their hands or other part of their limbs stuck within the structure illustrated. It should also be noted that the provision of the legs 24 of the hoop structure also provides safety to prevent that athlete from having his fingers caught behind or underneath the base plate 20 of the returning hoop structure 12.

Figure 5:
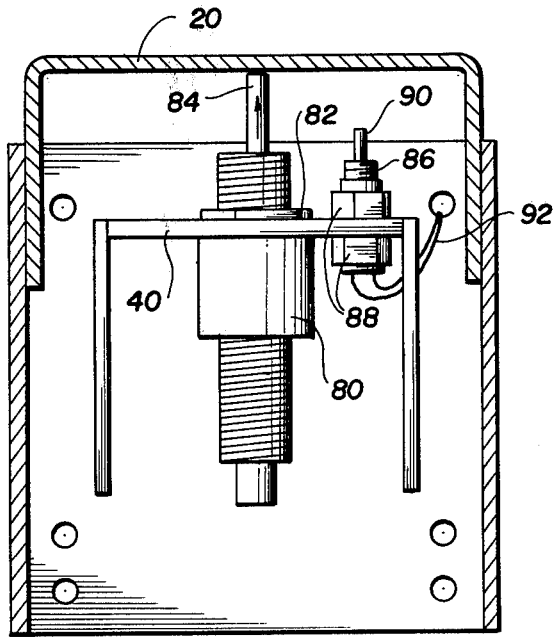
FIG. 5 is a cross-sectional view taken along lines 5—5 of FIG. 3.

To further decrease the stress placed on the support structure and the backboard by the hoop 16 returning from its reflected to its locked or home position, a dash pot or shock absorber 80 is mounted to the base plate 40 by fastener 82 and includes a plunger 84 which follows the base plate 20 of the hoop assembly 12. The dash pot 80 is a single direction-pot which freely moves in the up direction illustrated in FIG. 5 and resists the motion downward. This slows the return of the hoop 16 from its maximum reflected position back to its home and lock position to thereby reduce the impact on the support assembly and the backboard. Also mounted to plate 40 is a position switch 86 mounted thereto by fasteners 88 and including a plunger 90. The switch 86 is connected by wires 92 to a system behind the backboard. The plunger 90 follows the base plate 20 of the hoop assembly 12 to indicate when the hoop is unlocked and has started its downward or deflected motion. An indicator system connected to the switch 86 which may be a bell, buzzer or lights, will be activated to indicate that the rim has been unlocked and released. Since it does not form a part of the present invention, the indicator system is not described and illustrated in detail.

From the preceding description of the preferred embodiments, it is evident that the objects of the invention are attained in that a movable basketball hoop is provided which will meet the NCAA standards as well as providing other advantages and novel features. Although the invention has been described and illustrated in detail, it is to be clearly understood that the same is by way of illustration and example only and is not to be taken by way of limitation. The spirit and scope of the present invention are to be limited only by the terms of the appended claims.

What is claimed is:

1. In a mounting assembly for a horizontal basketball goal hoop structure having support structure for mounting to a backboard, means for pivotally mounting said hoop structure to said support structure, lock means for maintaining said hoop structure horizontal until a predetermined force is applied to said hoop structure and return means for returning said hoop structure to said horizontal position, the improvement comprising:

said return means includes a rail with a first seat secured thereto and a second seat slidably mounted thereto, compression means positioned between said first and second seats, said rail and said second seat being connected between said hoop and said support structures so as to move relative to each other and compress said compression means when said hoop structure pivots on said support structure from said horizontal position;

said compression means includes a first compression device which compresses during the initial portion of said pivotal movement and a second compression device which compresses during the final portion of said pivotal movement;

said lock means includes a detent having a locked position and an unlocked position; and interconnect means connecting said detent and said compression means for biasing said detent with said compression means.

2. The mounting assembly according to claim 1, wherein said first compression device is a spring and said second compression device is a resilient mass.

3. In a mounting assembly for a horizontal basketball goal hoop structure having support structure for mounting to a backboard, means for pivotally mounting said hoop structure to said support structure, lock means for maintaining hoop structure horizontal until a predetermined force is applied to said hoop structure and return means for returning said hoop structure to said horizontal position, the improvement comprising:

said return means includes a rail with a first seat secured thereto and a second seat slidably mounted thereto, compression means positioned between said first and second seats, said rail and said second seat being connected between said hoop and said support structures so as to move relative to each other and compress said compression means when said hoop structure pivots on said support structure from said horizontal position; and said lock means includes a detent means having a locked position and an unlocked position, said rail includes an indenture, said detent means in said locked position lies in said indenture to maintain said structure horizontal and said detent means is mounted to move relative to said rail and engage said rail in said unlocked position when said hoop structure pivots from said horizontal position.

4. The mounting assembly according to claim 3, including a dash pot means connected between said hoop structure and said support structure for damping the return pivotal movement of said hoop structure to said horizontal position.

5. The mounting assembly according to claim 3, including interconnecting means for transmitting the movement of said detent means from said locked to said unlocked position to said compression means to increase the compression of said compression means.

6. The mounting assembly according to claim 5 wherein said interconnecting means connects said detent means to said second seat to increase the compression of said compression means.

7. The mounting assembly according to claim 3, including interconnect means for transmitting the force of said compression means to said detent means to urge said detent means into said indenture and against said rail.

8. The mounting assembly according to claim 3, wherein said compression means includes a first compression device which compresses during the initial portion of said pivotal movement and a second compression device which compresses during the final portion of said pivotal movement.

9. The mounting assembly according to claim 3, wherein said pivotally mounting means mounts said hoop structure to pivot on said support about an axis displaced from said backboard.

10. The mounting assembly according to claim 3, wherein said detent means is positioned to have an axis of motion between said locked and unlocked position traverse to the axis of motion of said rail, and including interconnect means for interrelating the positions of said detent means and said second seats.

11. In a mounting assembly for a horizontal basketball goal hoop structure having support structure for mounting to a backboard, means for pivotally mounting said hoop structure to said support structure, lock means for maintaining said hoop structure until a predetermined force is applied to said hoop structure and return means for returning said hoop structure to said horizontal position, the improvement comprising:

said return means includes a rail with a first seat secured thereto and a second seat mounted thereto, compression means positioned between said first and second seats, said rail and said second seat being connected between said hoop and said support structures so as to move relative to each other and compress said compression means when said hoop structure pivots on said support structure from said horizontal position;

said lock means includes a detent having a locked position and an unlocked position; and interconnect means connecting said detent and said compression means for biasing said detent with said compression means and for transmitting the movement of said detent from said locked to said unlocked position to move said second seat relative to said rail of said for increasing the compression means.

12. The mounting assembly according to claim 11, wherein said rail has an indenture, said detent lying in said indenture in its locked position, and said rail and detent being mounted between said hoop structure and said support structure so as to move relative to each other when said predetermined force is applied to said hoop structure to move said detent to an unlocked position with the detent engaging a side of said rail when said hoop structure pivots on said support structure.

13. The mounting assembly according to claim 11, wherein said rail is connected to said hoop structure.

14. The mounting assembly according to claim 1, wherein said pivotally mounting means mounts said hoop structure to pivot on said support about an axis displaced from said backboard.

15. In a mounting assembly for a horizontal basketball goal hoop structure having support structure for mounting to a backboard, means for pivotally mounting said hoop structure to said support structure, lock means for maintaining said hoop structure until a predetermined force is applied to said hoop structure and return means for returning said hoop structure to said horizontal position, the improvement comprising:

said return means includes a rail with a first seat secured thereto and a second seat slidably mounted thereto, compression means positioned between said first and second seats, said rail and said second seat being connected between said hoop and said support structures so as to move relative to each other and compress said compression means when said hoop structures pivots on said support structure from said horizontal position;

said locking means includes a pair of opposed detents whose axis of movement is traverse to the axis of movement of said rail and which have a locked and unlocked position;

interconnect means connecting said detent and said compression means for biasing said detent with said compression means and including a pair of pivotally connected cams, each cam connecting the exterior side of a respective detent to said second seat for interrelating the positions of said detents and said second seat.

* * * * *

UNITED STATES PATENT AND TRADEMARK OFFICE

CERTIFICATE OF CORRECTION

PATENT NO. : 4,441,709

DATED : April 10, 1984

INVENTOR(S) : Edward A. Schroeder et al.

It is certified that error appears in the above—identified patent and that said Letters Patent is hereby corrected as shown below:

Column 1, line 43, delete "moveble" and insert --movable--.

Claim 14, line 1, delete "1" and insert --11--.

Signed and Sealed this

*Twenty-third* Day of *October 1984*

[SEAL]

*Attest:*

GERALD J. MOSSINGHOFF

*Attesting Officer*

*Commissioner of Patents and Trademarks*